US007600478B2

(12) United States Patent
Shimamura et al.

(10) Patent No.: US 7,600,478 B2
(45) Date of Patent: Oct. 13, 2009

(54) TRANSPORTATION VEHICLE SYSTEM

(75) Inventors: Ikuharu Shimamura, Inuyama (JP); Toyokazu Kobayashi, Inuyama (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 12/137,429

(22) Filed: Jun. 11, 2008

(65) Prior Publication Data

US 2009/0000505 A1 Jan. 1, 2009

(30) Foreign Application Priority Data

Jun. 28, 2007 (JP) ..... 2007-170225

(51) Int. Cl.
*B61J 3/00* (2006.01)

(52) U.S. Cl. ..... 104/88.04; 104/88.01

(58) Field of Classification Search ..... 104/88.01, 104/88.02, 88.03, 88.04; 701/19–20, 23–27
See application file for complete search history.

(56) References Cited

U.S. PATENT DOCUMENTS

| | | | | |
|---|---|---|---|---|
| 4,726,299 | A * | 2/1988 | Anderson | 104/88.02 |
| 6,721,627 | B2 * | 4/2004 | Udou et al. | 700/228 |
| 2005/0159854 | A1 * | 7/2005 | Hori et al. | 701/1 |
| 2005/0171656 | A1 * | 8/2005 | Hori et al. | 701/19 |
| 2006/0016363 | A1 * | 1/2006 | Nakao et al. | 104/88.01 |
| 2006/0051188 | A1 * | 3/2006 | Hoshino | 414/277 |
| 2006/0051192 | A1 * | 3/2006 | Fujiki | 414/626 |
| 2006/0182553 | A1 * | 8/2006 | Yamamoto et al. | 414/278 |
| 2006/0222479 | A1 * | 10/2006 | Shiwaku et al. | 414/267 |
| 2006/0230975 | A1 * | 10/2006 | Shiwaku | 104/88.01 |
| 2006/0271252 | A1 * | 11/2006 | Hori et al. | 701/23 |
| 2007/0027615 | A1 * | 2/2007 | Nagasawa | 701/200 |
| 2007/0028795 | A1 * | 2/2007 | Parati | 104/88.03 |
| 2007/0163461 | A1 * | 7/2007 | Shiwaku | 104/89 |
| 2008/0004761 | A1 * | 1/2008 | Yamada | 701/25 |
| 2009/0000505 | A1 * | 1/2009 | Shimamura et al. | 104/88.02 |
| 2009/0018717 | A1 * | 1/2009 | Reed et al. | 701/25 |

FOREIGN PATENT DOCUMENTS

| | | |
|---|---|---|
| JP | 2004-227059 | 8/2004 |
| JP | 2006-313767 | 11/2006 |
| JP | 2007137642 A | 6/2007 |

OTHER PUBLICATIONS

Japanese language office action its English language translation for corresponding Japanese application 2007170225 lists the reference above.

* cited by examiner

*Primary Examiner*—S. Joseph Morano
*Assistant Examiner*—Jason C Smith
(74) *Attorney, Agent, or Firm*—Hogan & Hartson LLP

(57) ABSTRACT

A plurality of intra-bay routes and an inter-bay route between the intra-bay routes are defined as a logic bay, and the minimum number of allocated transportation vehicles is determined based on the unit of each logic bay.

4 Claims, 4 Drawing Sheets

TRANSPORTATION VEHICLE SYSTEM

TECHNICAL FIELD

The present invention relates to a system for transportation vehicles such as overhead traveling vehicles, rail guided vehicles traveling on the ground, or automatic transportation vehicles.

BACKGROUND ART

In transportation vehicle systems such as overhead traveling vehicle systems, inter-bay routes are provided as long distance transportation routes and intra-bay routes are provided along a plurality of processing equipment. In general, the intra-bay route is a circular route. Vehicles are accessible to the inter-bay route at one or more positions. According to the disclosure of Japanese Laid-Open Patent Publication No. 2006-313767, the minimum number of transportation vehicles for each intra-bay route is determined, and if shortage of the vehicles occurs, additional vehicles are brought from other intra-bay routes, and no transportation to the outside of the bay is performed until arrival of the additional transportation vehicles. However, if the minimum number of transportation vehicles is determined for each bay, a large number of transportation vehicles are required. For example, if at least one transportation vehicle is allocated in each bay, the total number of the transportation vehicles needs to be at least the number of bays. If the minimum number of transportation vehicles is not determined, in an area where transportation is started, and the number of vehicles going out of the bay is large, shortage of vehicles occur, and wait time for transportation becomes extremely long.

DISCLOSURE OF THE INVENTION

Problems to be Solved by the Invention

An object of the present invention is to avoid extremely long wait time in bays, using a small number of transportation vehicles.

Another object of the present invention is to make it possible to execute transportation instructions efficiently even if there are not many transportation vehicles.

Still another object of the present invention is to make it possible to allocate transportation vehicles depending on distribution of transportation instructions.

Means for Solving the Problems

According to the present invention, a transportation vehicle system includes a large number of intra-bay routes and an inter-bay route connected to the intra-bay routes for allowing transportation vehicles to travel along each route. Adjacent intra-bay routes and a portion of the inter-bay route connecting the adjacent intra-bay routes are defined as a logic bay.

The system further includes logic bay control means for assigning transportation instructions to the transportation vehicles in the logic bay to maintain a number of the transportation vehicles in the logic bay to a minimum number or more.

Preferably, a buffer for a transportation article is provided along the inter-bay route, and the logic bay control means is configured to divide the transportation instruction for transportation from the inside of the logic bay to the outside of the logic bay into a transportation instruction for transportation from the intra-bay route in the logic bay to the buffer along the inter-bay route and a transportation instruction for the subsequent transportation, when the number of the transportation vehicles in the logic bay is the minimum number, for allowing the transportation vehicle in the logic bay to execute only the transportation instruction for transportation to the buffer.

Further, preferably, the transportation vehicle system further includes means for changing an area of the logic bay or the minimum number of the transportation vehicles, depending on the number of transportation instructions for transportation starting from the inside of the logic bay.

According to the present invention, a method of controlling a transportation vehicle system including a large number of intra-bay routes and an inter-bay route connected to the intra-bay routes for allowing transportation vehicles to travel along each route is provided, and the method includes the steps of:

defining adjacent intra-bay routes and a portion of the inter-bay route connecting the adjacent intra-bay routes as a logic bay; and assigning transportation instructions to the transportation vehicles in the logic bay to maintain a number of the transportation vehicles in the logic bay to a minimum number or more.

ADVANTAGES OF THE INVENTION

In the present invention, a plurality of bays are defined as one logic bay, and the minimum number of transportation vehicles is determined in the unit of the logic bay. For example, three or four bays are defined as a logic bay, and at least one or two transportation vehicles are allocated in the logic bay. In this manner, the number of transportation vehicles required in the transportation vehicle system is determined by accumulating the number of transportation vehicles required in each logic bay. As a result, in comparison with the case in which at least one transportation vehicle is allocated in each bay, it is possible to reduce the required number of transportation vehicles. Further, in the case of allocating the transportation vehicles in the units of the logic bays, though the transportation vehicle needs to travel without carrying any article from the adjacent bay to the loading bay, the wait time is determined by the travel time between the adjacent bays, and the wait time is not excessively long. Further, in the logic bay, even when only the minimum number of transportation vehicles are present, since it is possible to freely assign transportation instructions, the transportation efficiency is improved. In the present invention, using a relatively small number of transportation vehicles, it is possible to prevent excessively long wait time in the bays.

In the case where the number of the transportation vehicles is the minimum number in the unit of the logic bay, and a transportation instruction for transportation to the outside of the logic bay is generated, the original transportation instruction is divided into a transportation instruction for transportation to the buffer facing the inter-bay route in the logic bay, and a transportation instruction for the subsequent transportation. By permitting transportation to the buffer facing the inter-bay route in the logic bay, even in the case where only the minimum number of vehicles are present in the logic bay, it is possible to carry out transportation to the buffer. Consequently, the loading port or the like for processing equipment becomes available easily, and it is possible to transport the next article from the loading port. The subsequent transportation after the buffer should be carried out after waiting until another transportation vehicle becomes unoccupied.

By dynamically changing the size of the logic bay and the minimum number of the vehicles, depending on the concentration conditions of the transportation instructions, it is possible to allocate the transportation vehicles depending on distribution of transportation instructions.

BRIEF DESCRIPTION OF THE DRAWINGS

FIG. 1 is a view showing a layout of a transportation vehicle system according to an embodiment.

FIG. 2 is a block diagram showing a system controller according to the embodiment.

FIG. 3 is a flow chart showing an algorithm of controlling logic bays according to the embodiment.

FIG. 4 is a flow chart showing an algorithm of assigning transportation instructions according to the embodiment.

DESCRIPTION OF THE NUMERALS

Figure 1:
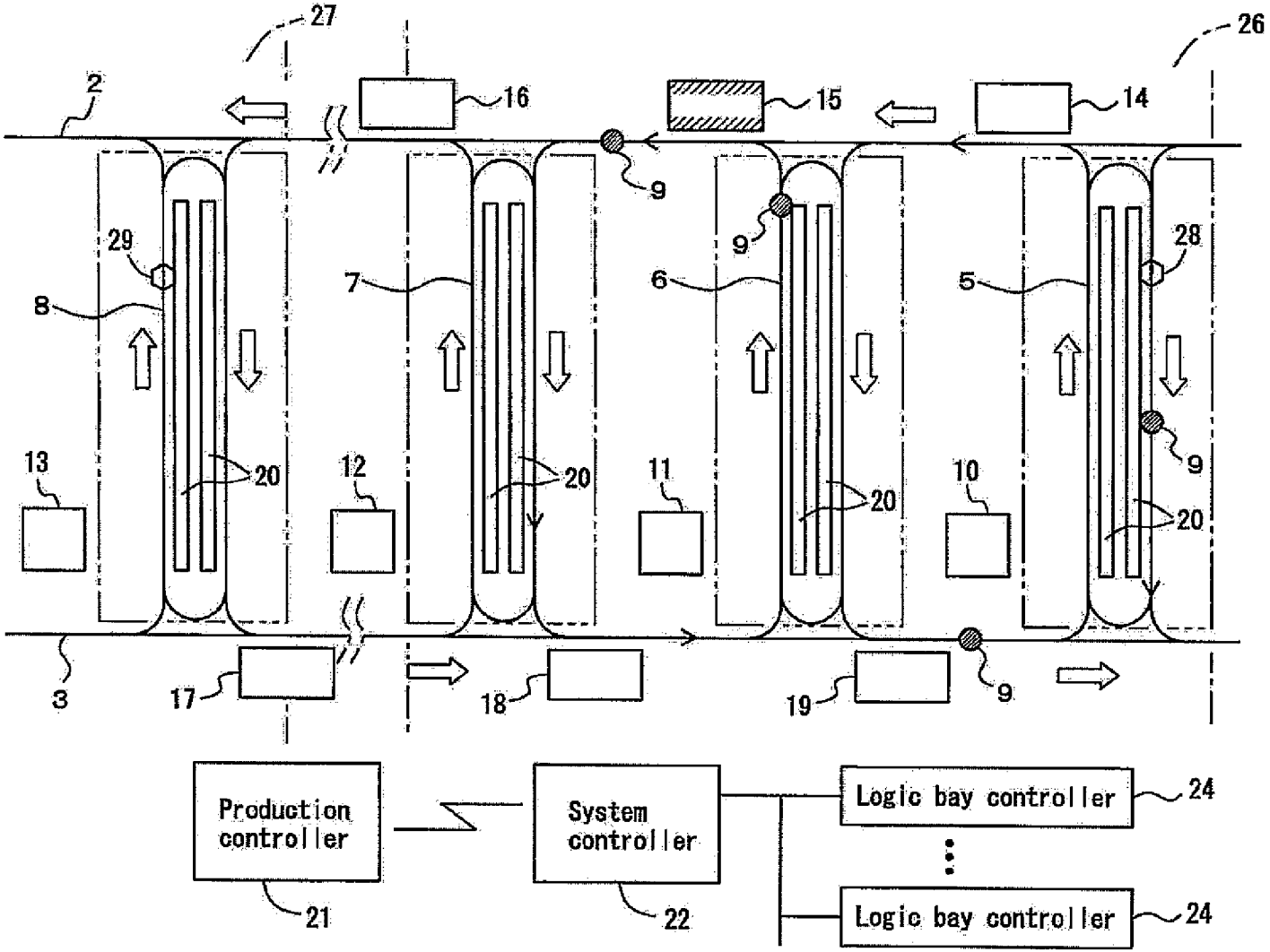
[FIG. 1]

2, 3: inter-bay route
5 to 8: intra-bay route
9: overhead traveling vehicle
10 to 13: bay controller
14 to 19: inter-bay buffer
20: buffer
21: production controller
22: system controller
24: logic bay controller
26, 27: logic bay
28: loading port
29: unloading port
30, 31: communication interface
32: transportation request file
33: transportation instruction file
34: vehicle state file
36: logic bay control unit
38: instruction division processing unit
40: vehicle allocation unit

EMBODIMENT

FIGS. 1 to 4 show a system for transportation vehicles according to an embodiment. For example, the transportation vehicles are overhead traveling vehicles. Alternatively, the transportation vehicles may be rail guided vehicles traveling on the ground or automatic transportation vehicles. Further, though the transportation vehicle system is provided in a semiconductor factory in the embodiment, the transportation vehicle system can be used in arbitrary applications. In the drawings, reference numerals 2 and 3 denote inter-bay routes interconnecting intra-bay routes. In FIG. 1, some of the intra-bay routes 5 to 8 are shown. In the routes 2 to 8, overhead traveling vehicles 9 travel in directions indicated by blanked arrows. The overhead traveling vehicles 9 transport articles, e.g., between the intra-bay routes 5 to 8 or the like through the inter-bay routes 2, 3.

Bay controllers 10 to 13 are provided the intra-bay routes 5 to 8, respectively. Electricity is supplied to the overhead traveling vehicles 9 in a non-contact manner, and a feeding line for non-contact electricity feeding is provided in each of the intra-bay routes. Using the non-contact electricity feeding line, communication between the bay-controllers 10 to 13 and the overhead traveling vehicle 9 is carried out. Therefore, in practice, the bay-controller 10 to 13 is provided in each of the bays. It should be noted that the inter-bay routes 2, 3 are divided into a plurality of segments, and the non-contact electricity feeding line and the controller are provided in each of the segments.

Inter-bay buffers 14 to 19 such as stockers are provided along the inter-bay routes 2, 3, and articles such as semiconductor cassettes are transferred between the inter-bay buffers 14 to 19 and the overhead traveling vehicles 9. In the intra-bay routes 5 to 8, buffers 20 are provided below, and sides of the travel routes. The stocker is an apparatus having an entrance, an exit, and transportation means between the entrance or the exit and a rack. The buffers 20 are racks without any covers provided below, and sides of the travel routes (travel rails). No transportation means is provided for the buffers 20. Using a transfer apparatus of the overhead traveling vehicle 9, articles are transferred between the buffers 20 and the overhead traveling vehicle 9. Stockers may be provided in the intra-bay routes 5 to 8 as buffers. Alternatively, the inter-bay buffers 14 to 19 may be realized by buffers below and sides of the travel routes instead of the stockers.

A reference numeral 21 denotes a production controller for controlling semiconductor fabrication in semiconductor processing equipment or the like. A reference numeral 22 denotes a system controller for controlling the transportation vehicle system using the overhead traveling vehicles 9. A logic bay controller 24 is provided in each of the logic bays 26, 27 for controlling the overhead traveling vehicles 9 in the logic bays 26, 27. The logic bay controller 24 is realized by software using the hardware resource in the system controller 22. The number of logic bay controllers 24 changes dynamically. The logic bay controller 24 performs assignment of transportation instructions or the like, and communication with the overhead traveling vehicles 9 is carried out by the bay controllers 10 to 13. The logic bay controller 24 controls the number of the overhead traveling vehicles in each of the logic bays 26, 27, assigns transportation instructions to the overhead traveling vehicles 9, and checks execution results of the transportation instructions.

The logic bays 26, 27 include, e.g., about two to four adjacent intra-bay routes, and inter-bay routes between the intra-bay routes. The logic bay controller 24 is provided in each of the logic bays 26, 27. For example, the minimum number of the overhead traveling vehicles 9 assigned to the logic bays 26, 27 is one to three.

It is assumed that an article is transported from a loading port 28 of the intra-bay route 5 to an unloading port 29 of the intra-bay route 8, and only the minimum number of the overhead traveling vehicles are present in the logic bay 26 of the starting point. In this case, even when an unoccupied overhead traveling vehicle is present in the logic bay 26, if the article is transported to the unloading port 29, the number of the overhead traveling vehicles in the logic bay 26 becomes less than the minimum number. Therefore, it is not possible to assign transportation instructions. Under the circumstances, firstly, the article is transported to the inter-bay buffer in the logic bay 26. Then, after an overhead traveling vehicle becomes available in the inter-bay route 2 for assigning a transportation instruction to the overhead traveling vehicle, or after the number of transportation vehicles in the logic bay is increased, the article is transported from the inter-bay buffer to the unloading port 29. In the case of FIG. 1, for example, in the logic bay 26, the article is transported to the inter-bay buffer 15 on the downstream side in the logic bay 26.

Figure 2:
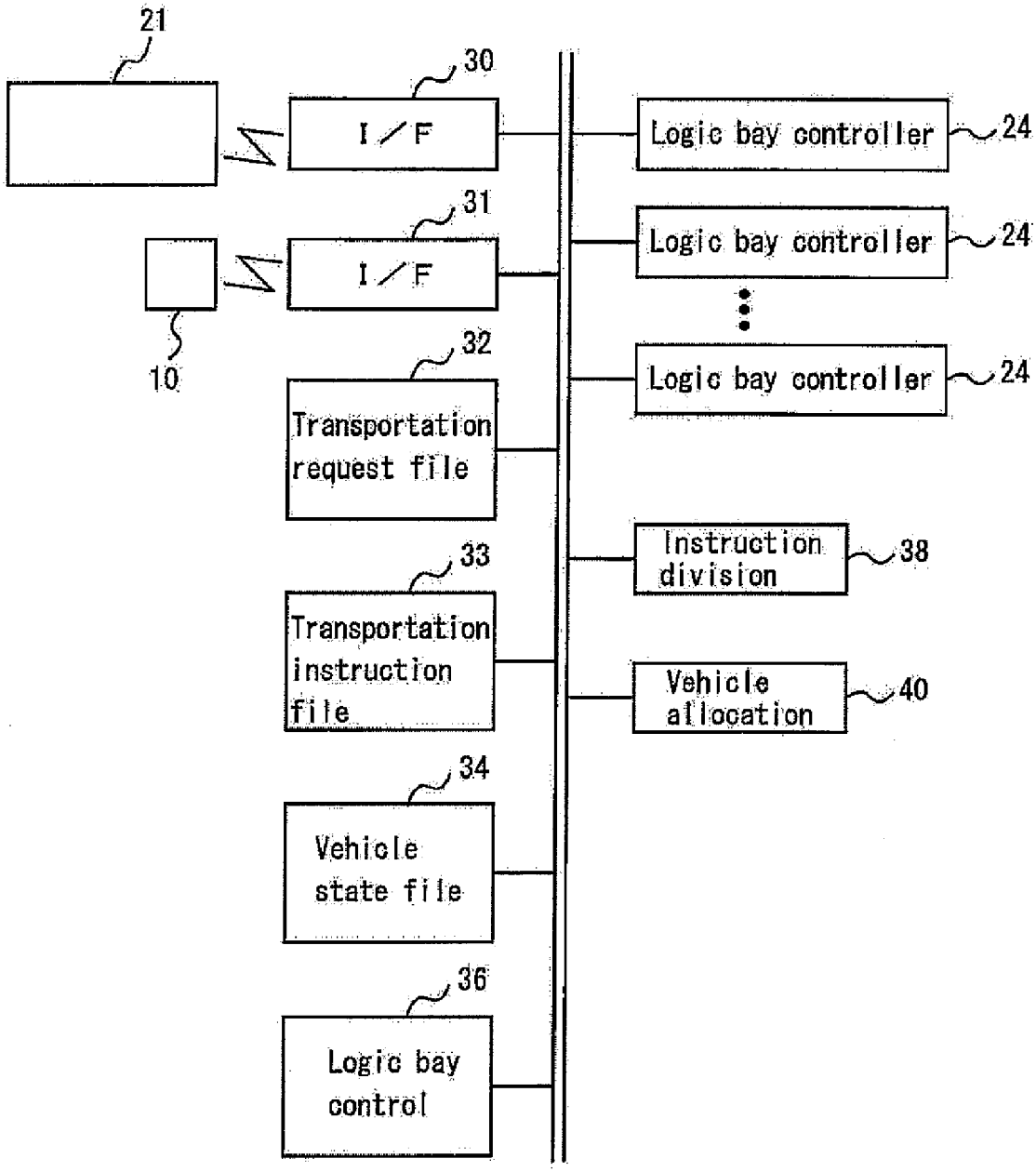
[FIG. 2]

FIG. 2 shows structure of the system controller 22. Reference numerals 30, 31 denote communication interfaces for communication with the production controller 21, the bay controller 10 or the like. A transportation request file 32 is a file storing the transportation request received from the production controller 21. A transportation instruction file 33 stores transportation instructions converted from transportation requests. In storing the transportation instructions, these transportation instructions are classified into unassigned instructions, assigned instructions, finished instructions or the like. Data of the transportation instructions includes loading ports or buffers, unloading ports or buffers, and IDs of transportation articles. The ports designate equipment for transportation of the articles out of or into the processing equipment. The IDs of the articles in the transportation instructions may be omitted.

The transportation request from the loading port to the unloading port can be divided into a transportation instruction for transportation from the unloading port to the buffer, and a transportation instruction for transportation from the buffer to the unloading port. Therefore, data of the transportation instruction may be different from data of the transportation request. A vehicle state file 34 stores numbers of bays where transportation vehicles are present or numbers of logic bays, and states of transportation vehicles such as waiting, traveling to the loading port, executing the transportation instruction after starting loading, or assignment failure.

A logic bay control unit 36 checks the load condition in each logic bay, and divides the logic bay having a high load into a plurality of logic bays, or increases the minimum number of overhead traveling vehicles to reduce the transportation load. Further, the logic bay control unit 36 combines logic bays having low loads, or reduces the minimum number of the vehicles to increase the transportation load. When the logic bay controller 24 divides a transportation instruction, an instruction division processing unit 38 adds the resulting transportation instruction for transportation after the inter-bay buffer, and stores it in the transportation instruction file 33. A vehicle allocation unit 40 controls allocation of vehicles in each logic bay such that unoccupied transportation vehicles from the other logic bays are allocated. Instead of directly performing division of the transportation instruction by the logic bay controller 24, the system controller 22 may divide the transportation instruction upon a request from the logic bay controller 24.

Figure 3:
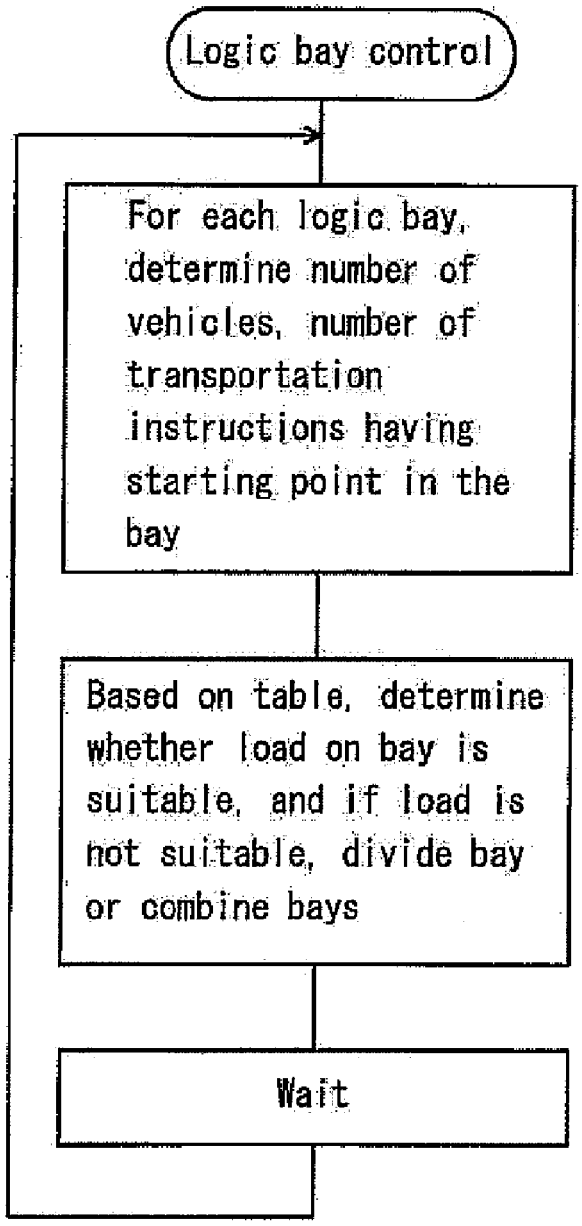
[FIG. 3]

FIG. 3 shows control of the logic bay in the embodiment. For each logic bay, the number of transportation vehicles in the bay, and the number of transportation instructions having a starting point inside the bay are determined. The number of transportation instructions having a starting point inside of the bay represents the load on the logic bay. In this regard, in the case of the transportation instruction having a destination outside the bay, since the number of vehicles in the logic bay is reduced, the weight of the load is increased in comparison with the case of the transportation instruction having a destination inside the bay. The logic bay control unit 36 in FIG. 2 has a table for controlling the logic bay. For example, an appropriate number of transportation instructions corresponding to the minimum number of the transportation vehicles in the bay are written in the table.

The minimum number of transportation vehicles in the bay and the number of transportation instructions arc compared with data of the table. If the load is too heavy, for example, the logic bay is divided into a plurality of parts. If the load is too light, the logic bay is combined with the adjacent logic bay. The data managed by the logic bay controller 24 includes the number of the overhead traveling vehicles in the logic bay, the assigned transportation instructions or the like. The actual communication with the overhead traveling vehicles is carried out by the bay controller. Further, each bay controller stores data regarding the correspondence between the presence of the overhead traveling vehicles 9 and the bays. Therefore, it is possible to easily change the area of the logic bay dynamically.

Figure 4:
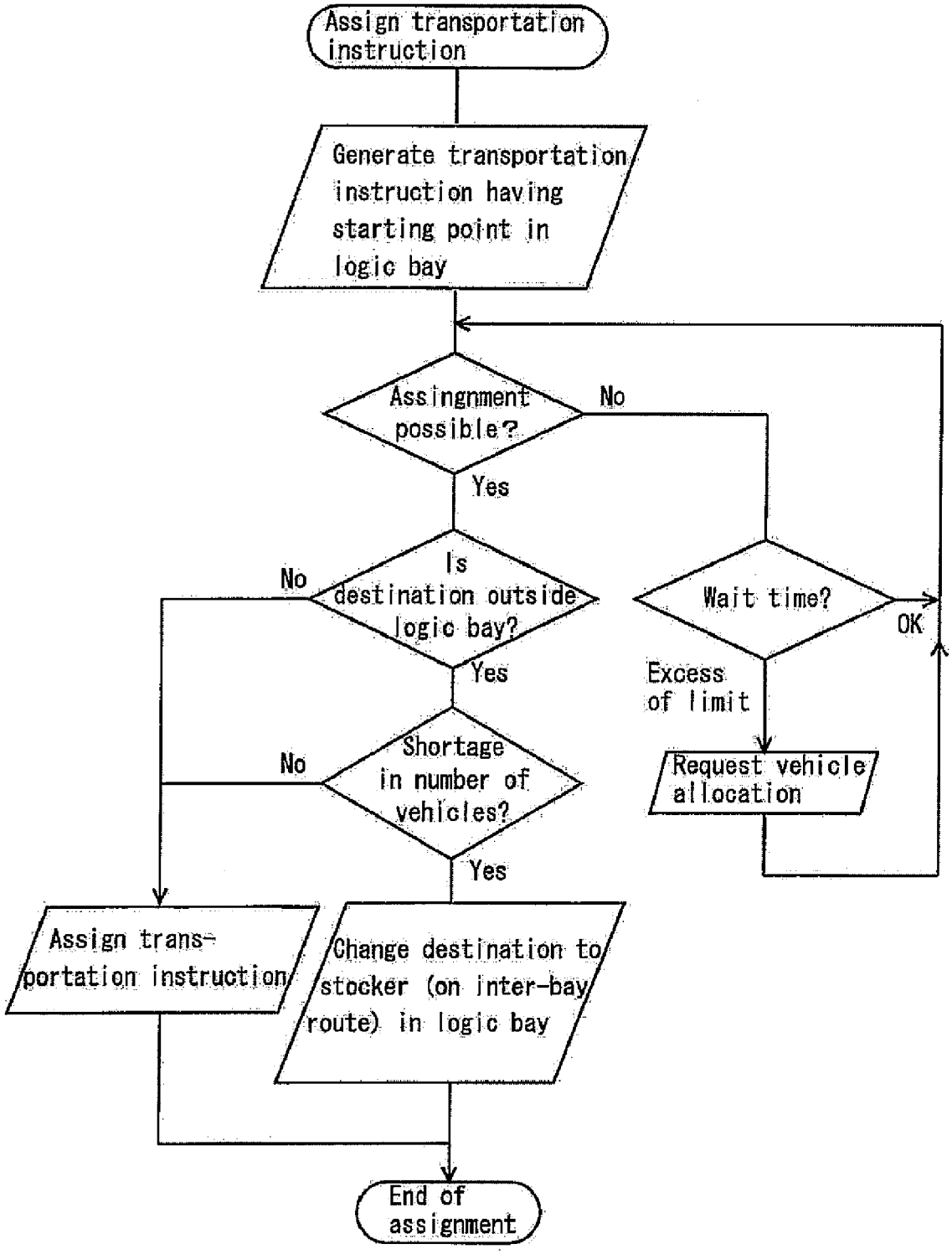
[FIG. 4]

FIG. 4 is a flow chart showing assignment of the transportation instructions. When a transportation instruction having a starting point inside the logic bay is generated, and there is an overhead traveling vehicle to which the transportation instruction can be assigned, it is determined whether the destination is inside or outside the logic bay. In the case where the destination is outside the logic bay, since the number of transportation vehicles in the logic bay is reduced, if the current number of the vehicles is larger than the minimum number of the vehicles, the transportation instruction is assigned, and if the current number of the vehicles is the minimum number of the vehicles, the destination is changed to a stocker along the inter-bay route in the logic bay. Transportation instructions for transportation after the stocker are accumulated as unassigned instructions, e.g., in the transportation instruction file. At this time, information to the effect that the transportation instruction is divided may be reported to the production controller, and the production controller may change the production schedule. In the case where a transportation instruction is generated, and no overhead traveling vehicle to which the transportation instruction can be assigned is present, wait time from generation of the transportation instruction is checked. If the wait time exceeds the limit, allocation of the vehicle is requested to the vehicle allocation unit.

The following advantages are obtained in the embodiment.

(1) Since the minimum number of the overhead traveling vehicles is determined in the unit of the intra-bay routes as a whole, the number of the required overhead traveling vehicles is minimized.

(2) In comparison with the case where the total number of the overhead traveling vehicles is determined in each of the intra-bay routes, if the total number of the overhead traveling vehicle remain the same, since loading and unloading can be carried out in a wide area, the transportation efficiency is improved advantageously.

(3) Even in the case where shortage of overhead traveling vehicles occurs, and the unloading destination is outside the logic bay, since it is possible to transport the article to the buffer along the inter-bay route, it is possible to reduce the wait time until the end of transportation. Further, it is possible to prevent the loading port from being occupied.

(4) The area of the logic bay or the minimum number of the overhead traveling vehicles in the unit of the logic bay is changed dynamically depending on the load on each logic bay. Therefore, allocation of the overhead traveling vehicles is carried out efficiently.

(5) Since the logic bay is wider than the intra-bay route, the travel time of the overhead traveling vehicle until loading becomes relatively long. However, since the logic bay is made up of the adjacent intra-bay routes, the wait time is not increased significantly.

The invention claimed is:

1. A transportation vehicle system comprising a plurality of intra-bay routes and an inter-bay route connected to the intra-bay routes for allowing transportation vehicles to travel along each route:

the system further comprising at least a logic bay comprising and defined as adjacent intra-bay routes and a portion of the inter-bay route connecting the adjacent intra-bay routes;

logic bay control means for assigning transportation instructions to the transportation vehicles in the logic bay to maintain a number of the transportation vehicles in the logic bay to a minimum number or more; and a buffer for a transportation article along said portion of the inter-bay route, the logic bay control means for dividing a transportation instruction for transportation from an inside of the logic bay to an outside of the logic bay into a transportation instruction for transportation from an intra-bay route in the logic bay to the buffer along said portion of the inter-bay route and a transportation instruction from the buffer to the outside of the logic bay, when the number of the transportation vehicles in the logic bay is the minimum number, for allowing the transportation vehicle in the logic bay to execute only the transportation instruction for transportation to the buffer.

2. The transportation vehicle system according to claim 1 further comprising means for changing the logic bay in a number of the adjacent intra-bay routes and said portion of the inter-bay route or the minimum number of the transportation vehicles, according to the number of transportation instructions for transportation starting from the inside of the logic bay.

3. A method of controlling a transportation vehicle system comprising a plurality of intra-bay routes and an inter-bay route connected to the intra-bay routes for allowing transportation vehicles to travel along each route, the method including the steps of:

defining adjacent intra-bay routes and a portion of the inter-bay route connecting the adjacent intra-bay routes as a logic bay; and assigning transportation instructions to the transportation vehicles in the logic bay to maintain a number of the transportation vehicles in the logic bay to a minimum number or more;

providing a buffer for a transportation article alone said portion of the inter-bay route; and dividing a transportation instruction for transportation from an inside of the logic bay to an outside of the logic bay into a transportation instruction for transportation from an intra-bay route in the logic bay to the buffer along said portion of the inter-bay route and a transportation instruction from the buffer to the outside of the logic bay, when the number of the transportation vehicles in the logic bay is the minimum number, for allowing the transportation vehicle in the logic bay to execute only the transportation instruction for transportation to the buffer.

4. The method of controlling a transportation vehicle system according to claim 3, further comprising the step of:

changing the minimum number of the transportation vehicles, according to the number of transportation instructions for transportation starting from the inside of the logic bay.

* * * * *